US011274795B2

(12) United States Patent
Graeber et al.

(10) Patent No.: US 11,274,795 B2
(45) Date of Patent: Mar. 15, 2022

(54) LNG REGASIFICATION

(71) Applicant: Siemens Energy Global GmbH & Co. KG, Munich (DE)

(72) Inventors: Carsten Graeber, Erlangen (DE); Uwe Juretzek, Erlangen (DE)

(73) Assignee: Siemens Energy Global GmbH & Co. KG, Munich (DE)

( * ) Notice: Subject to any disclaimer, the term of this patent is extended or adjusted under 35 U.S.C. 154(b) by 106 days.

(21) Appl. No.: 16/767,622

(22) PCT Filed: Sep. 4, 2018

(86) PCT No.: PCT/EP2018/073712
§ 371 (c)(1),
(2) Date: May 28, 2020

(87) PCT Pub. No.: WO2019/158230
PCT Pub. Date: Aug. 22, 2019

(65) Prior Publication Data

US 2020/0393085 A1 Dec. 17, 2020

(30) Foreign Application Priority Data

Feb. 16, 2018 (EP) ..... 18157209

(51) Int. Cl.
*F17C 9/04* (2006.01)
*F25J 3/02* (2006.01)

(52) U.S. Cl.
CPC ..... *F17C 9/04* (2013.01); *F25J 3/0214* (2013.01); *F17C 2221/033* (2013.01);
(Continued)

(58) Field of Classification Search
USPC ..... 62/50.2
See application file for complete search history.

(56) References Cited

U.S. PATENT DOCUMENTS 7,028,481 B1 4/2006 Morrow
2008/0178611 A1 7/2008 Ding
(Continued)

FOREIGN PATENT DOCUMENTS

CN 102261272 A 11/2011
CN 104482403 A 4/2015
(Continued)

OTHER PUBLICATIONS

PCT International Search Report and Written opinion dated Oct. 25, 2018 corresponding to International PCT Application PCT/EP2018/073712 filed Sep. 4, 2018.

*Primary Examiner* — Timothy P. Kelly
*Assistant Examiner* — Christopher M Afful

(57) ABSTRACT

An apparatus and method for generating electrical energy and for vaporising a cryogenically liquefied gas, the device having a conduit for the cryogenically liquefied gas, a pump located in the conduit, a heat engine, and a waste-heat recovery system downstream of the heat engine, wherein a branch conduit branches off from the conduit and the branch conduit leads into the heat engine, and wherein the apparatus also has a fluid circuit with the following components arranged successively in the flow direction of the fluid: a first heat exchanger which is also connected in the flow direction of the cryogenically liquefied gas past the pump into the conduit; a compressor; a second heat exchanger; parallel to one another, a third heat exchanger with a first side, and the waste-heat recovery system; a depressurising machine having a coupled generator; and the third heat exchanger with a second side.

13 Claims, 1 Drawing Sheet

(52) U.S. Cl.
CPC ..... *F17C 2223/0161* (2013.01); *F17C 2223/033* (2013.01); *F17C 2225/0123* (2013.01); *F17C 2227/0135* (2013.01); *F17C 2227/0157* (2013.01); *F17C 2227/0393* (2013.01); *F17C 2265/05* (2013.01); *F17C 2265/07* (2013.01)

(56) References Cited

U.S. PATENT DOCUMENTS

| | | | | |
|---|---|---|---|---|
| 2009/0211263 | A1* | 8/2009 | Coyle ..... | F25J 3/0233 62/50.2 |
| 2010/0107634 | A1 | 5/2010 | Xu et al. | |
| 2011/0289941 | A1 | 12/2011 | Gonzalez Salazar et al. | |

FOREIGN PATENT DOCUMENTS

| | | | |
|---|---|---|---|
| EP | 0009387 | A1 | 4/1980 |
| EP | 0470532 | A1 | 2/1992 |
| JP | H09138063 | A | 5/1997 |
| JP | H10288047 | A | 10/1998 |
| JP | 2003056312 | A | 2/2003 |
| JP | 2009203860 | A | 9/2009 |
| JP | 2014218922 | A | 11/2014 |
| WO | 2010009371 | A1 | 1/2010 |

* cited by examiner

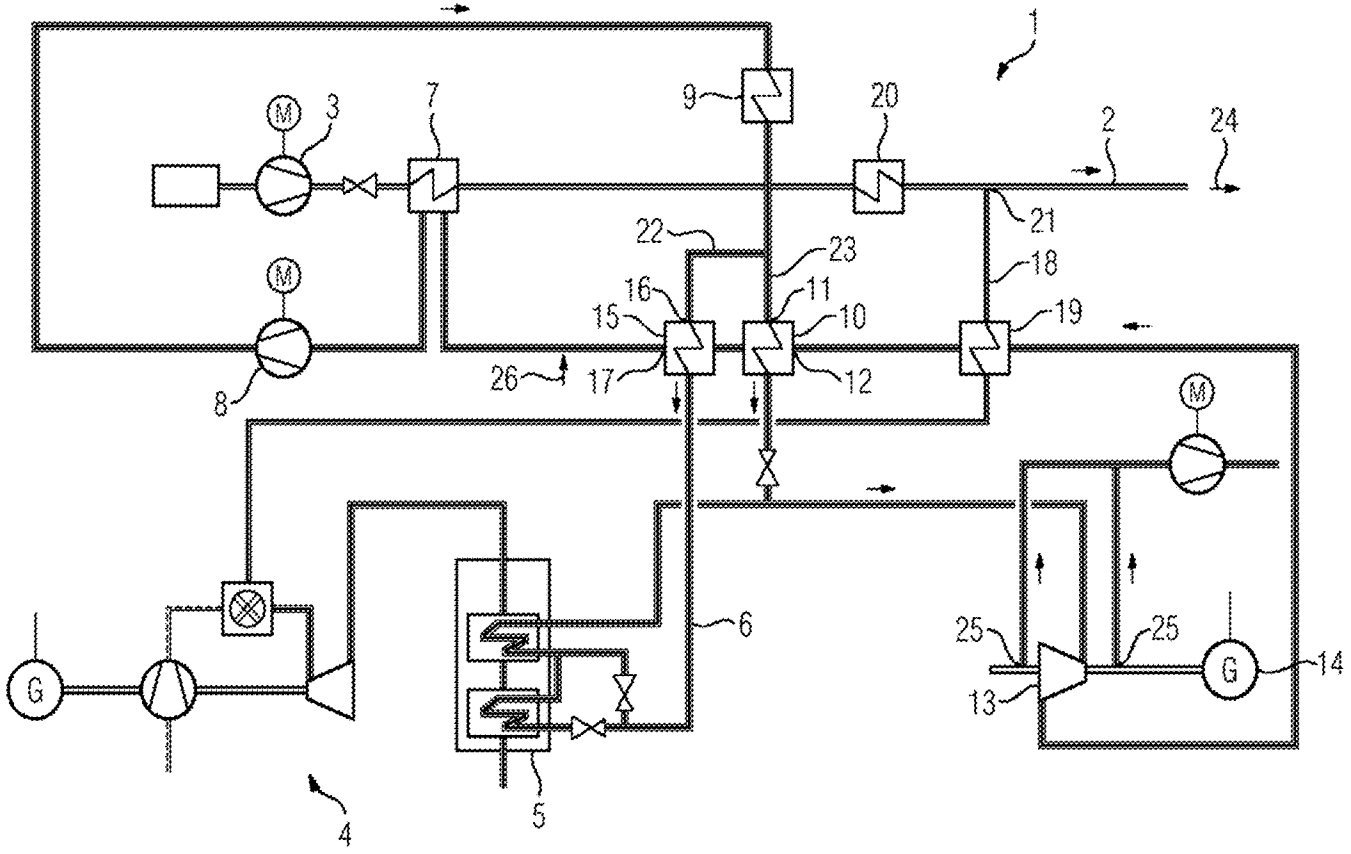
1
2
3
4
5
6
7
8
9
10
11
12
13
14
15
16
17
18
19
20
21
22
23
24
25
25
26
M
M
M
G
G

LNG REGASIFICATION

CROSS REFERENCE TO RELATED APPLICATIONS

This application is the US National Stage of International Application No. PCT/EP2018/073712 filed 4 Sep. 2018, and claims the benefit thereof. The International Application claims the benefit of European Application No. EP18157209 filed 16 Feb. 2018. All of the applications are incorporated by reference herein in their entirety.

FIELD OF INVENTION

The invention relates to an apparatus for inexpensively generating electric energy and for vaporizing a low-temperature liquefied gas, for example natural gas (LNG=liquefied natural gas), and also a corresponding process.

BACKGROUND OF INVENTION

After it has been extracted, natural gas is usually transported via pipelines to appropriate terminals in a port. There, it is stored, treated and finally liquefied by high compression and cooling (down to −162° C.) for transport over longer distances on appropriate specialty ships. After transport, the liquefied natural gas is regasified before introduction into a gas grid. The liquid natural gas is in this case typically vaporized by means of ambient heat (air/sea water) or chemical heat. US 2009/0211263 A1 discloses, for example, an apparatus and a process in which a liquid natural gas stream is vaporized.

As an alternative, concepts which had the objective of utilizing the energy of the low-temperature cold by means of cascaded ORCs have been developed.

SUMMARY OF INVENTION

It is an object of the invention to provide a vaporization process which is energetically favorable and comparatively inexpensive for a low-temperature liquefied gas. A further object of the invention is to provide a correspondingly improved apparatus.

The invention achieves the object directed to an apparatus by providing, in an apparatus of this type for generating electric energy and vaporizing a low-temperature liquefied gas, comprising a conduit for the low-temperature liquefied gas, a pump arranged in the conduit, a heat engine and a waste heat utilization system located downstream of the heat engine, for a branched conduit to branch off from the conduit and the branch conduit to open into the heat engine and the apparatus to further comprise a fluid circuit in which the following components are arranged in succession in the flow direction of the fluid:—a first heat exchanger which is installed in the conduit further in the flow direction of the low-temperature liquefied gas downstream of the pump, —a compressor, —a second heat exchanger, —in parallel, a first side of a third heat exchanger and the waste heat utilization system, —an expansion engine with coupled generator and—a second side of the third heat exchanger.

Low-temperature liquefied gas means that the gas has been liquefied by cooling. The temperatures in the case of the gases relevant to the invention are in the order of −140° C. and below. Coupling of the vaporization of the low-temperature liquefied gas to further processes and in particular optimized heat integration of the total system make it possible to achieve maximum utilization of the low-temperature cold for generating electric power with very high efficiencies.

The fluid circuit should be operated as a single-pressure process in order to optimize the efficiency of the apparatus. This requires not only a particular temperature but also a corresponding pressure provided by the compressor.

In the second heat exchanger, the fluid is heated by means of ambient heat. If a gas turbine is used as a heat engine, a possible application would be cooling the intake air of the gas turbine, which results in an increase in power of the gas turbine. However, other heat sources can also be used, such as, for example, warmed cooling water, seawater or ambient air.

Heat is deftly moved within the fluid circuit by means of the third heat exchanger.

In the expansion engine, for example a turbine, the fluid which has been heated in the waste heat utilization system can be expanded to provide work. A generator is optionally coupled to the expansion engine.

In an advantageous embodiment of the invention, a first side of a fourth heat exchanger is arranged in parallel with the first side of the third heat exchanger and upstream in the flow direction of the fluid of the waste heat utilization system in the fluid circuit. A second side of this fourth heat exchanger is further arranged downstream in the flow direction of the fluid of the second side of the third heat exchanger in the fluid circuit. In order to avoid corrosion problems at the cold end of the waste heat utilization system, the fluid fed to the waste heat utilization system should have a temperature which does not go below a particular value. This would be ensured by preheating by means of the fourth heat exchanger. Otherwise, omission of the fourth heat exchanger and undertaking of a comparatively early repair of the cold part of the waste heat utilization system could also bring about better utilization of the waste heat in the waste heat utilization system.

In a further advantageous embodiment of the invention, a fifth heat exchanger is arranged in the branched conduit and in the fluid circuit upstream of the second side of the third heat exchanger in order to preheat the fuel for combustion in the heat engine. The preheating of the fuel increases the sensible heat of the fuel and reduces the amount of fuel required.

It is advantageous for a sixth heat exchanger to be arranged in the conduit before a branching-off point of the branch conduit. This sixth heat exchanger is intended to utilize heat from the surroundings in order to heat up the regasified gas further. Here, it is useful for this not to occur downstream of the branch but instead upstream, so that less heat has to be taken from the system, i.e. the fluid circuit, in order to achieve a desired temperature level in the actual fuel gas preheating in the fifth heat exchanger.

The apparatus claimed is able to be utilized for various low-temperature liquefied gases. However, it is advantageous for the low-temperature liquefied gas to be natural gas, not only because of its utility in the heat engine but also in respect of the choice of the fluid in the fluid circuit and the efficiency of the overall plant. An alternative to natural gas is, for example, hydrogen.

In this context, it is particularly advantageous for the fluid circuit to be a nitrogen circuit. The use of nitrogen is advantageous because of, not least, its inert properties. However, it is of importance that nitrogen which has a critical point of −147° C./34 bara is outstandingly suitable for supercritical heat exchange with the LNG. The supercritical state prevents the formation of an isothermal condensation plateau. The exergetic losses in heat transfer are minimized thereby. Furthermore, the solidification temperature of −210° C. is significantly below the LNG temperature of −162° C., so that freezing-out of the fluid is not possible.

The object directed to a process is achieved by a process for generating electric energy and for vaporizing a low-temperature liquefied gas, in which a low-temperature liquefied gas is compressed and heated and vaporized by means of a fluid stream in a first heat exchanger, the fluid stream being circulating, with it being compressed downstream of the first heat exchanger, taking up heat in a second heat exchanger, being divided into a first substream and a second substream, with the first substream being heated at least in a waste heat utilization system by means of exhaust gases of a heat engine and the second substream being heated in a third heat exchanger and the first substream and the second substream being combined again, the combined fluid being depressurized and subsequently heating the second substream in the third heat exchanger before it heats the low-temperature liquefied gas in the first heat exchanger.

It is advantageous for the first substream, before it is heated in the waste heat utilization system, to be heated by the fluid in a fourth heat exchanger after the fluid has heated the second substream in the third heat exchanger. The arrangement in series of the second sides of the third and fourth heat exchangers is advantageous compared to joint preheating of the total fluid stream since the first substream is in any case subjected to comparatively strong heating in the waste heat utilization system and excessive "preheating" of the fluid would have an overall adverse effect on the efficiency of the total plant, if a comparatively large quantity of heat would have to be released unutilized into the surroundings because of a comparatively high entry temperature of the fluid in the region of entry into the waste heat utilization system.

It is additionally advantageous for the formerly low-temperature liquefied gas to be fed at least partly to a gas grid and partly to the heat engine.

It is also advantageous for the formerly low-temperature liquefied gas fed to the heat engine to be preheated by way of the fluid in a fifth heat exchanger for a combustion before it heats the second substream in the third heat exchanger.

It is advantageous for nitrogen to be used as fluid in the fluid circuit.

It is particularly advantageous here for the fluid circuit to be a circuit operated under supercritical conditions. In the supercritical state, the heat of vaporization no longer plays any role, which has a positive effect on efficient heat transfer.

Liquefied natural gas is advantageously used as low-temperature liquefied gas.

According to the invention, the regasification process (advantageously LNG) and also the circulation process (advantageously nitrogen) are operated as a single-pressure process through to, in each case, the supercritical pressure range for optimum heat exchange. This makes it possible to leave the entire exhaust gas heat introduced into the process by the gas turbine exhaust gas in the system, optimizing efficiency.

Furthermore, the inventive concept enables, in an advantageous way, the LNG to be adjusted to the desired pressure and temperature level at the terminal point to the gas grid.

In addition, the design of the fluid circuit is optimized in respect of the requirements of the subsystems (e.g. both the final LNG temperature and a minimum nitrogen temperature on entry into the waste heat utilization system downstream of the gas turbine are made possible by the internal heat shift).

The optimum combination of the systems and optimum selection of the process parameters make it possible, for example, to achieve LNG-to-electricity conversion efficiencies of 61-64%. In this way, a level which is not foreseeable within the next five years using conventional GUD technology is attained.

Further advantages are: •all process parameters can be realized using components which are already available at present, •the power station does not require any water for operation thereof, •a simple process structure allows simple regulation (e.g. only one pressure stage in the nitrogen process instead of a plurality), •the process is environmentally friendly since, compared to previous regasification approaches, potentially environmentally damaging media such as glycol are not present, •apparatus and process are very inexpensive since no additional active components are required on the LNG side and •the concept performance is independent of the LNG system pressure.

BRIEF DESCRIPTION OF THE DRAWINGS

The invention will be illustrated in more detail by way of example with the aid of the drawing. In the drawing, schematically and not true-to-scale:

FIG. 1 shows an apparatus for generating electric energy and for vaporizing liquefied natural gas according to the invention.

DETAILED DESCRIPTION OF INVENTION

FIG. 1 schematically shows, by way of example, an apparatus 1 according to the invention. It comprises a conduit 2 for the low-temperature liquefied gas, for example natural gas, and a pump 3 arranged in the conduit 2. Furthermore, the apparatus 1 in FIG. 1 comprises a gas turbine as a heat engine 4 and also a waste heat utilization system 5 similar to a waste heat steam generator in gas and steam turbine plants located downstream of the heat engine 4. However, the invention does not provide a water-steam circuit.

The fluid circuit 6 could be, for example, a nitrogen circuit and in the working example of FIG. 1 comprises the following components in succession in the flow direction of the fluid: —a first heat exchanger 7 which is installed in the conduit 2 further in the flow direction of the low-temperature liquefied gas downstream of the pump 3; in the first heat exchanger 7, heat is, for example, transferred by nitrogen to the liquefied natural gas, resulting in the liquefied natural gas warming up and vaporizing, —a compressor 8 by means of which the fluid/the nitrogen can be brought to the supercritical pressure range for optimum heat exchange, —a second heat exchanger 9 in which ambient heat (for example from a gas turbine intake air cooling facility, seawater, ambient air, warmed-up cooling water) is utilized for heating the fluid, —in parallel, a first side 11 of a third heat exchanger 10 in a second substream 23 and a first side 16 of a fourth heat exchanger 15 and the waste heat utilization system 5 in a first substream 22 of the fluid, —a turbine as an expansion engine 13 with coupled generator 14, —a fifth heat exchanger 19 for preheating of fuel, —a second side 12 of the third heat exchanger 10 and—a second side 17 of the fourth heat exchanger 15.

In the working example of FIG. 1, part of the depressurized natural gas is fed to a gas grid 24 and another part is fed to the gas turbine (heat engine 4). For this purpose, a branch conduit 18 branches off from the conduit 2 at the branching-off point 21. The branch conduit 18 opens into the gas turbine (heat engine 4). To preheat fuel, the fifth heat exchanger 19 is, as indicated above, installed in the branch conduit 18 and in the fluid circuit 6 (=nitrogen circuit).

In the working example of FIG. 1, a sixth heat exchanger 20 is also arranged in the conduit 2 upstream of a branching-off point 21 of the branch conduit 18.

The turbine 13 in which nitrogen is expanded in the working example of FIG. 1 has leakages. These can be at least partly extracted 25 and then recirculated into the fluid circuit 6. In general, an introduction 26 of nitrogen into the fluid circuit 6 is provided.

The invention claimed is:

1. An apparatus for generating electric energy and for vaporizing a low-temperature liquefied gas, comprising:

a conduit for the low-temperature liquefied gas, a pump arranged in the conduit, a heat engine, a waste heat utilization system located downstream of the heat engine, a branch conduit which branches off from the conduit, wherein the branch conduit opens into the heat engine, and a fluid circuit in which the following components are arranged in succession in a flow direction of the fluid:

a first heat exchanger which is installed in the conduit further in the flow direction of the low-temperature liquefied gas downstream of the pump, a compressor, a second heat exchanger, in parallel, a first side of a third heat exchanger and the waste heat utilization system, an expansion engine with coupled generator, and a second side of the third heat exchanger.

2. The apparatus as claimed in claim 1, wherein a first side of a fourth heat exchanger is arranged in parallel to the first side of the third heat exchanger and upstream in the flow direction of the fluid of the waste heat utilization system in the fluid circuit, and wherein a second side of the fourth heat exchanger is arranged downstream in the flow direction of the fluid of the second side of the third heat exchanger in the fluid circuit.

3. The apparatus as claimed in claim 2, wherein a fifth heat exchanger is arranged in the branch conduit and in the fluid circuit upstream of the second side of the third heat exchanger.

4. The apparatus as claimed in claim 3, wherein a sixth heat exchanger is arranged in the conduit upstream of a branching-off point of the branch conduit.

5. The apparatus as claimed in claim 1, wherein the low-temperature liquefied gas is natural gas.

6. The apparatus as claimed in claim 1, wherein the fluid circuit is a nitrogen circuit.

7. A process for generating electric energy and for vaporizing a low-temperature liquefied gas, the process comprising:

compressing, heating, and vaporizing a low-temperature liquefied gas by a fluid stream in a first heat exchanger, wherein the fluid stream is circulating in a fluid circuit, with it being compressed downstream of the first heat exchanger, taking up heat in a second heat exchanger, being divided into a first substream and a second substream, with the first substream being heated at least in a waste heat utilization system by exhaust gases of a heat engine and the second substream being heated in a third heat exchanger and the first substream and the second substream being combined again into a combined fluid, the combined fluid being depressurized and subsequently heating the second substream in the third heat exchanger before it heats the low-temperature liquefied gas in the first heat exchanger.

8. The process as claimed in claim 7, wherein the first substream, before it is heated in the waste heat utilization system, is heated by the fluid in a fourth heat exchanger after the fluid has heated the second substream in the third heat exchanger.

9. The process as claimed in claim 7, wherein the formerly low-temperature liquefied gas is fed at least partly to a gas grid and partly to the heat engine.

10. The process as claimed in claim 9, wherein the formerly low-temperature liquefied gas fed to the heat engine is preheated by way of the fluid in a fifth heat exchanger for a combustion before it heats the second substream in the third heat exchanger.

11. The process as claimed in claim 7, wherein nitrogen is used as fluid in the fluid circuit.

12. The process as claimed in claim 11, wherein the fluid circuit is operated under supercritical conditions.

13. The process as claimed in claim 7, wherein liquefied natural gas is used as low-temperature liquefied gas.

* * * * *